US010869531B2

(12) United States Patent
Park

(10) Patent No.: US 10,869,531 B2
(45) Date of Patent: Dec. 22, 2020

(54) APPARATUS FOR MAKEUP REMOVAL

(71) Applicant: L'OREAL, Paris (FR)

(72) Inventor: Kyoo Jin Park, Leonia, NJ (US)

(73) Assignee: L'OREAL, Paris (FR)

( * ) Notice: Subject to any disclaimer, the term of this patent is extended or adjusted under 35 U.S.C. 154(b) by 31 days.

(21) Appl. No.: 16/263,810

(22) Filed: Jan. 31, 2019

(65) Prior Publication Data

US 2020/0245744 A1 Aug. 6, 2020

(51) Int. Cl.
*A45D 34/04* (2006.01)

(52) U.S. Cl.
CPC ..... *A45D 34/042* (2013.01); *A45D 34/045* (2013.01); *A45D 2200/1018* (2013.01); *A45D 2200/1063* (2013.01)

(58) Field of Classification Search
CPC .... A45D 40/267; A45D 34/00; A45D 34/042; A45D 34/043; A45D 34/045; A45D 40/26; A45D 40/262; A45D 40/264; A45D 40/265; A45D 2200/1063
See application file for complete search history.

(56) References Cited

U.S. PATENT DOCUMENTS

| | | | | |
|---|---|---|---|---|
| 2,158,901 A * | 5/1939 | Martin | A45D 34/045 401/129 |
| 2,267,179 A | 12/1941 | Wells | |
| 2,509,369 A | 5/1950 | Roberson | |
| 3,195,544 A * | 7/1965 | Politzer | A45D 29/007 401/183 |
| 6,186,971 B1 * | 2/2001 | Naughton | A45D 29/007 206/210 |
| 2011/0129287 A1 | 6/2011 | Lecoutre | |

FOREIGN PATENT DOCUMENTS

| | | |
|---|---|---|
| JP | 4-247425 A | 9/1992 |
| JP | 4247425 B2 | 4/2009 |

* cited by examiner

*Primary Examiner* — David J Walczak
(74) *Attorney, Agent, or Firm* — Oblon, McClelland, Maier & Neustadt, L.L.P.

(57) ABSTRACT

An apparatus for removing makeup includes a body, including a cap, a stem, and an applicator tip; and a bottle, including a reservoir configured to hold a solution, wherein the applicator tip is disposed at a first end of the stem and a second end of the stem is attached to the cap; the stem and applicator tip are comprised of compressed fibers; and a color of the stem and applicator tip is determined based on a color of a cosmetic used by a user.

15 Claims, 3 Drawing Sheets

APPARATUS FOR MAKEUP REMOVAL

BACKGROUND

The application of a multitude of cosmetics materials to the face, nails, body surfaces, etc., often results in smudges, misapplications, imperfections, undesired result, etc., needing correction. The user may attempt to quickly correct the imperfections or misapplications using their fingers, but the results are less than optimal, imprecise, or messy. Alternatively, the user may use a single-use product that may not be cleaned and re-used again, resulting in additional waste. Consequently, an apparatus which enables a user to correct a mistake, or multiple mistakes, using a single applicator retaining a volume of makeup removing solution may reduce makeup application time and reduce waste. Accordingly, better methods and systems for removing desired materials, such as makeup or nail polish, from a surface are desired.

The "background" description provided herein is for the purpose of generally presenting the context of the disclosure. Work of the presently named inventors, to the extent it is described in this background section, as well as aspects of the description otherwise qualify as prior art at the time of filing, are neither expressly or impliedly admitted as prior art against the present invention.

SUMMARY

In an embodiment, the present disclosure relates to an apparatus for makeup removal, including, among other things, a body, including a cap, a stem, and an applicator tip; and a bottle, including a reservoir configured to hold a solution, wherein the applicator tip is disposed at a first end of the stem and a second end of the stem is attached to the cap; the stem and applicator tip are comprised of compressed fibers; and a color of the stem and applicator tip is determined based on a color of a cosmetic used by a user.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
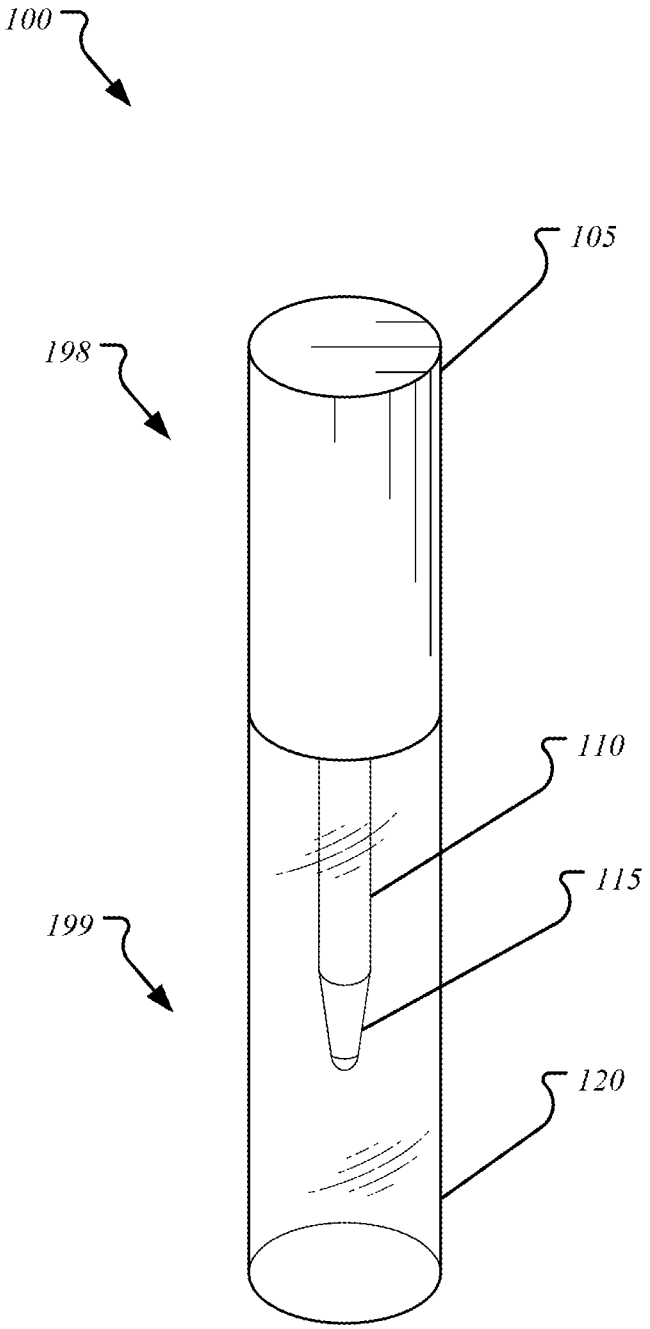
FIG. 1 is a perspective view schematic of a makeup remover apparatus, according to an exemplary embodiment of the present disclosure.

FIG. 1 illustrates a perspective view of a makeup remover apparatus 100, according to an exemplary embodiment of the present disclosure. In an embodiment, the makeup remover apparatus 100 includes a body 198 and a bottle 199. In an embodiment, the body 198 is configured to couple with the bottle 199. For example, the body 198 is twist-tightened to the bottle 199. For example, the body 198 is snap-tightened to the bottle 199.

Figure 2B:
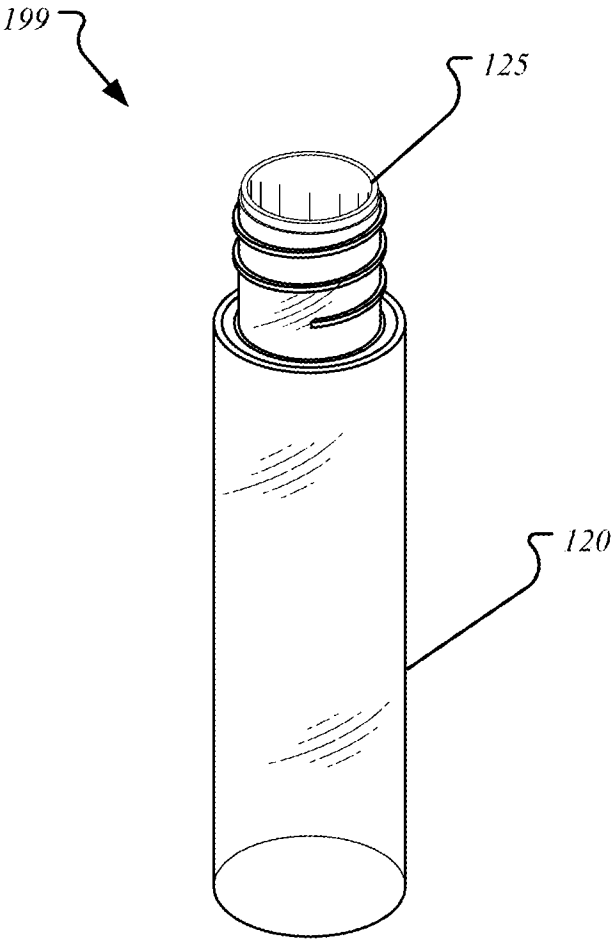
FIG. 2B is a perspective view schematic of a makeup remover bottle, according to an exemplary embodiment of the present disclosure.
Figure 2A:
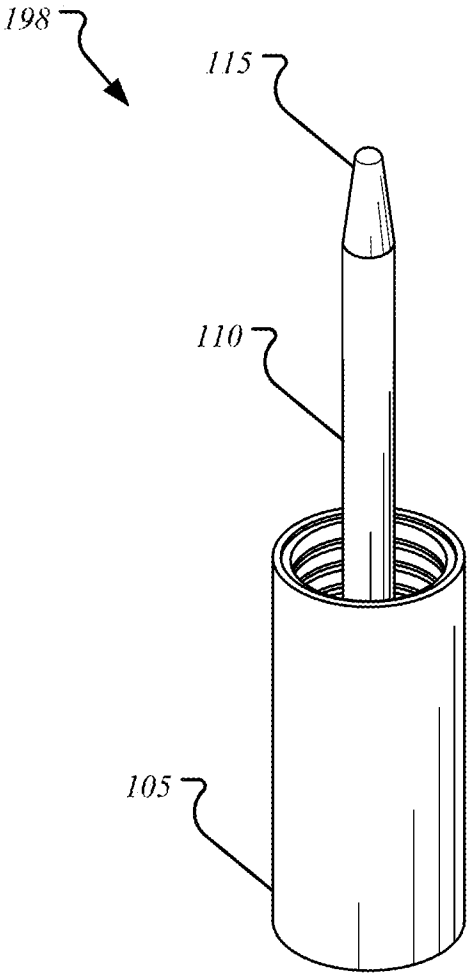
FIG. 2A is a perspective view schematic of a makeup remover body, according to an exemplary embodiment of the present disclosure.

FIG. 2A illustrates a perspective view of the body 198, according to an exemplary embodiment of the present disclosure. In an embodiment, the body 198 includes a cap 105, a stem 110, and an applicator tip 115. The applicator tip 115 is disposed at a first end of the stem 110. The cap 105 is configured to secure the stem 110 at a second end of the stem 110. The cap 105 is fabricated from a polymer or a metal. The stem 110 and applicator tip 115 is fabricated from a plurality of fibers that are compressed, wherein the plurality of fibers are aligned along their length. The applicator tip 115 is an extension of the stem 110, wherein the plurality of fibers is formed into a tapered shape at the first end of the stem 110. In an embodiment, the applicator tip 115 is configured to contact a surface and spread a solution. For example, the applicator tip 115 is configured to spread makeup remover onto a user's skin. The applicator tip 115 is partially frayed to improve its spreading efficiency. A material of the stem 110 and applicator tip 115 includes at least one of the group polyester, polyethylene terephthalate, cotton, and silk.

FIG. 2B illustrates a perspective view of the bottle 199, according to an exemplary embodiment of the present disclosure. In an embodiment, the bottle 199 includes a reservoir 120 and an opening 125 disposed at a first end of the bottle 199.

In an embodiment, the stem 110 is inserted into the opening 125, wherein the applicator tip 115 is inserted first. The opening 125 has an outer diameter substantially equal to or slightly thinner than an inner diameter of the cap 105. The opening 125 is inserted into the interior of the cap 105 and forms a seal with the sidewall of the interior of the cap 105. In an embodiment, the reservoir 120 is configured to hold the solution, and the seal formed prevents leakage of the solution.

In an embodiment, the reservoir 120 is a predetermined volume of empty space in an interior of the bottle 199. For example, the reservoir 120 holds makeup removing solution. For example, the reservoir 120 holds nail polish remover.

In an embodiment, the body 198 is configured to remove makeup from the user's skin. The stem 110 is configured to absorb and retain the solution, for example the makeup removing solution, from the reservoir 120 through the applicator tip 115 when the stem 110 and applicator tip 115 are submerged in the reservoir 120. The plurality of fibers in the stem 110 absorb and retain the makeup removing solution via capillary forces until the plurality of fibers is saturated. In an embodiment, the applicator tip 115 is brushed against the user's skin, wherein makeup removing solution is pulled from the stem 110 and applicator tip 115 and applied to the user's skin. The makeup removing solution then dissolves the makeup on the user's skin and the applicator tip 115 is configured to wick the dissolved makeup off the user's skin. This is repeated at multiple spots until the makeup removing solution retained in the stem 110 is consumed. The applicator tip 115 (and stem 110) is submerged in the reservoir 120 to deposit the dissolved makeup from the user's skin in the reservoir 120. The submersion also allows the stem 110 and applicator tip 115 to absorb and retain additional makeup removing solution for subsequent application and makeup removal.

In an embodiment, the solution is nail polish remover. The applicator tip 115 is configured to dissolve and remove nail polish applied to a nail of the user in a similar manner as described previously. If the user desires to create a pattern on the user's nail, the applicator tip 115 provides a fine point sufficient for removing lines of a predetermined thickness (or thinness) in a coat of nail polish on the user's skin.

In an embodiment, the color of the plurality of compressed fibers in the stem 110 and applicator tip 115 are fabricated to be a predetermined color. The predetermined color is determined by the intended use of the stem 110 and applicator tip 115 with cosmetics used by the user. For example, the predetermined color is black for use with black mascaras or black eyeliners. The black color of the stem 110 also provides aesthetic appeal by not providing contrast for the user to see accumulated makeup on the stem 110. In another non-limiting example, the color of the stem 110 provides contrast against the cosmetic for the user to see accumulated makeup on the stem 110. For example, the predetermined color is white or clear for removing nail polish in order to visibly determine if pigmented nail polish is being removed.

Figure 3:
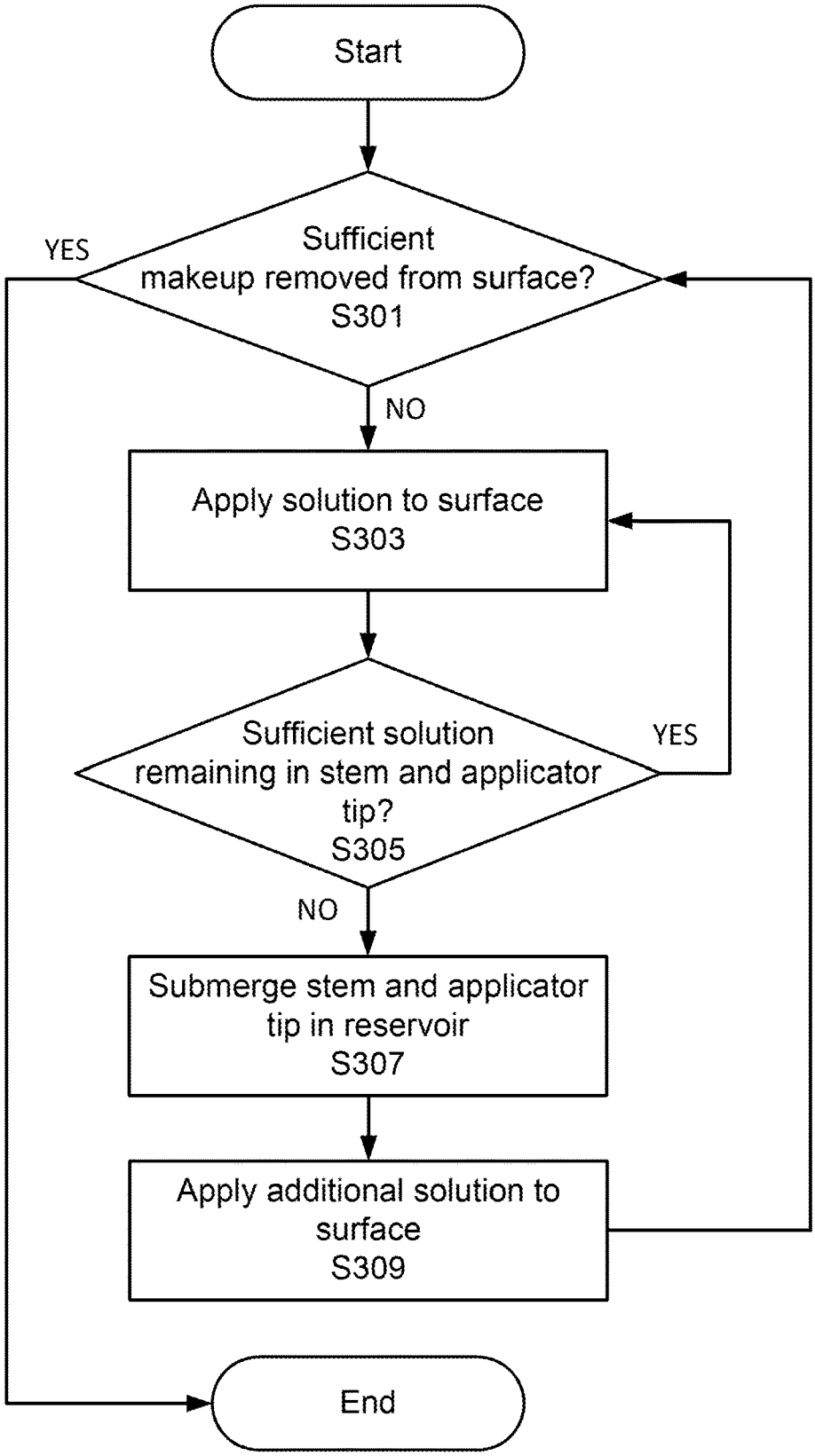
FIG. 3 is a flow chart for a method of applying a solution using a makeup remover apparatus, according to an exemplary embodiment of the present disclosure.

FIG. 3 illustrates a flow chart for a method of applying the solution using the makeup remover apparatus 100, according to an exemplary embodiment of the present disclosure. In step S301, if sufficient makeup has not been removed, solution is applied in step S303. In step S305, if sufficient solution remains in the stem 110 and applicator tip 115, solution continues to be applied as in step S303. Otherwise, the stem 110 and applicator tip 115 are submerged in the solution in the reservoir 120 to absorb additional solution in step S307. In step S309, additional solution is applied. In step S301, if sufficient solution has been removed, the process ends.

Advantageously, the plurality of compressed fibers of the stem 110 and applicator tip 115 retain more solution as compared to a non-absorbing stem in other applicators, for example a stem fabricated from a solid polymer. Thus, the user benefits from a decreased need to submerge the stem 110 and applicator tip 115 in the solution in the reservoir 120 in order to absorb additional solution.

The description above in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one aspect", "one embodiment", "an aspect", or "an embodiment" means that a particular feature, structure, characteristic, operation, or function described in connection with an embodiment is included in at least one embodiment of the disclosed subject matter. Thus, any appearance of the phrases "one aspect", "one embodiment", "an aspect", or "an embodiment" in the specification is not necessarily referring to the same aspect or embodiment. Further, the particular features, structures, characteristics, operations, or functions may be combined in any suitable manner in one or more aspects or embodiments. Further, it is intended that aspects or embodiments of the disclosed subject matter can and do cover modifications and variations of the described aspects or embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "upper," "lower," "front," "rear," "side," "interior," "exterior," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

A number of embodiments have been described. Nevertheless, it will be understood that various modifications are made without departing from the spirit and scope of this disclosure. For example, preferable results are achieved if the steps of the disclosed techniques were performed in a different sequence, if components in the disclosed systems were combined in a different manner, or if the components were replaced or supplemented by other components.

The foregoing discussion describes merely exemplary embodiments of the present disclosure. As will be understood by those skilled in the art, the present disclosure may be embodied in other specific forms without departing from the spirit or essential characteristics thereof. Accordingly, the disclosure is intended to be illustrative, but not limiting of the scope of the disclosure, as well as the claims. The disclosure, including any readily discernible variants of the teachings herein, defines in part, the scope of the foregoing claim terminology such that no inventive subject matter is dedicated to the public.

The invention claimed is:

1. An apparatus for removing makeup, comprising:

a body, including a cap, a stem, and an applicator tip; and a bottle, including a reservoir that holds a cosmetic removing solution, wherein the applicator tip is disposed at a first end of the stem and a second end of the stem is attached to the cap;

the stem and applicator tip are comprised of compressed fibers; and the compressed fibers are aligned along a length direction of the stem and formed into a tapered shape at the applicator tip.

2. The apparatus of claim 1, wherein a color of the stem and applicator tip is black.

3. The apparatus of claim 1, wherein a material of the stem and applicator tip include at least one of the group polyester, polyethylene terephthalate, cotton, and silk.

4. The apparatus of claim 1, wherein the stem and applicator tip absorb the cosmetic removing solution via capillary force.

5. The apparatus of claim 4, wherein the cosmetic removing solution is retained in the stem; and in response to contact between the applicator tip and a surface, the cosmetic removing solution retained in the stem is expelled onto the surface.

6. The apparatus of claim 1, wherein the cosmetic removing solution is a nail polish removing solution.

7. The apparatus of claim 6, wherein the applicator tip is configured to contact a nail of a user and remove a portion of a coating of nail polish in contact with the applicator tip using the nail polish removing solution.

8. The apparatus of claim 1, wherein the cosmetic removing solution is a makeup removing solution.

9. The apparatus of claim 8, wherein the applicator tip is configured to contact a skin of a user and remove a portion of a coating of makeup in contact with the applicator tip using the makeup removing solution.

10. The apparatus of claim 1, wherein the applicator tip is configured to remove a desired material on a surface and retain the removed desired material on a surface of the applicator tip, and the applicator tip is configured to be submerged in the cosmetic removing solution in the reservoir to remove the retained removed desired material on the surface of the applicator tip.

11. The apparatus of claim 1, wherein ends of the compressed fibers terminate at the applicator tip.

12. The apparatus of claim 1, wherein the applicator tip is at least partially frayed at a point of the tapered shape of the applicator tip.

13. An apparatus for removing makeup, comprising:

a body, including a cap, a stem, and an applicator tip, wherein the applicator tip is disposed at a first end of the stem and a second end of the stem is attached to the cap;

the stem and applicator tip are comprised of compressed fibers; and the compressed fibers are aligned along a length direction of the stem and formed into a tapered shape at the applicator tip.

14. The apparatus of claim 13, wherein ends of the compressed fibers terminate at the applicator tip.

15. The apparatus of claim 13, wherein the applicator tip is at least partially frayed at a point of the tapered shape of the applicator tip.

* * * * *